US006915753B1

(12) United States Patent
De Baan

(10) Patent No.: US 6,915,753 B1
(45) Date of Patent: Jul. 12, 2005

(54) MOORING APPARATUS

(75) Inventor: Jacob De Baan, Maassluis (NL)

(73) Assignee: Bluewater Energy Services BV, (NL)

( * ) Notice: Subject to any disclaimer, the term of this patent is extended or adjusted under 35 U.S.C. 154(b) by 96 days.

(21) Appl. No.: 10/752,822

(22) Filed: Jan. 7, 2004

(30) Foreign Application Priority Data

Mar. 13, 2003 (GB) ..... 0305799

(51) Int. Cl.[7] ..... B63B 21/00
(52) U.S. Cl. ..... 114/230.14; 441/5
(58) Field of Search ..... 441/3–5; 114/230.14, 114/263, 231, 258

(56) References Cited

U.S. PATENT DOCUMENTS 4,031,582 A 6/1977 Van Heijst
4,606,294 A 8/1986 Di Tella et al.

FOREIGN PATENT DOCUMENTS

| | | |
|---|---|---|
| EP | 0105976 | 10/1982 |
| EP | 1400442 A1 | 3/2004 |
| GB | 2056391 A | 3/1981 |
| GB | 2328197 A | 2/1999 |

*Primary Examiner*—Jesus D. Sotelo
(74) *Attorney, Agent, or Firm*—Fulwider Patton Lee & Utecht, LLP

(57) ABSTRACT

Apparatus is described for mooring a floating vessel (10) particularly suited to a tanker transporting liquid natural gas which needs to be moored in an offshore environment. The apparatus comprises a semi-submersible floating dock (1) a single point mooring system (5) and at least one rigid arm (3). The arm (3) is pivotally attached to one of the dock (1) and the single point mooring system (5). The arm (3) is suspended from the other of the dock (1) and the single point mooring system (5) by at least one tension member (19).

24 Claims, 6 Drawing Sheets

MOORING APPARATUS

BACKGROUND OF THE INVENTION

1. Field of the Invention

The present invention relates to apparatus for mooring a floating vessel in open sea, using a semi-submersible floating dock.

2. General Background and State of the Art

There is a fast growing demand for Liquid Natural Gas (LNG) in developed countries and as a result there is an increased need to import LNG into these countries.

Unfortunately, due to the nature of LNG as a cryogenic fluid, i.e. a gas in a cooled liquid form, it is perceived that there are a number of risks associated with its handling. For this reason, it is often difficult to obtain permission for the construction and operation of LNG receiving terminals, particularly in areas that may be densely populated, either at the shore or in harbours.

Alternatively, the LNG receiving terminals can be located offshore, away from any populated areas. However, transferring LNG between two offshore structures can pose a number of significant technical difficulties due to the large relative motions that may result between the vessels as a result of wave action acting upon them. Current offloading apparatus does little to reduce the effects of wave action upon two offshore vessels and consequently there is a need for improved fluid transfer apparatus.

It is known to use a submersible dock to transfer fluid from a first vessel to a receiving terminal. Typical arrangements of this sort are disclosed in patent documents GB 2,056,391, U.S. Pat. No. 3,841,501 and FR 1,421,700. However, such arrangements invariably suffer from operational disadvantages.

GB 2,056,391 discloses a submersible dock comprising a frame which is connected via a rigid articulated arm to an anchoring member on the seabed. Being rigidly connected to the sea bed the frame has limited movement in a vertical direction. Consequently, it would be unsuitable for mooring a tanker in heavy seas.

Conversely, U.S. Pat. No. 3,841,501 discloses a submersible dock having a range of movement limited only by the length of the fluid supply line. There are no integral means for mooring the tanker, other than to the submersible dock itself, and so the tanker must instead be moored by attachment to a separate buoy or submerged buoyant body.

There is therefore a need for a loading dock which can overcome these disadvantages and which is able to rigidly moor a vessel yet permit sufficient motion of the mooring means such that fluid transfer between the vessel and the receiving terminal can occur in heavy seas.

INVENTION SUMMARY

The present invention provides apparatus for mooring a floating vessel comprising a semi-submersible floating dock, a single point mooring system and at least one rigid arm, wherein the rigid arm is pivotally attached to one of the semi-submersible floating dock and the single point mooring system and is suspended from the other of the semi-submersible floating dock and the single point mooring system by at least one tension member.

In a first embodiment the single point mooring system comprises a seabed mounted structure and the at least one rigid arm is attached to the structure for rotation about a substantially vertical axis relative to the structure and for rotation about a substantial horizontal axis in use.

In a further embodiment, the single point mooring system comprises a floating vessel and the at least one rigid arm is attached to the vessel for rotation about a substantially horizontal axis in use.

Advantageously, the further embodiment may comprise two rigid arms, each pivotally mounted to the dock for rotation about a substantially horizontal axis in use and suspended from the floating vessel by at least one tension member.

In addition, the floating vessel may itself be moored by a single point mooring system.

Typically, the at least one rigid arm is a substantially triangular frame.

Generally, the at least one rigid arm is a substantially triangular frame.

Generally, the at least one rigid arm is attached to the single point mooring system at an apex of the substantially triangular frame.

Preferably, at least one flexible hose is connected between a swivel on the single point mooring system and the dock for fluid transfer therebetween.

Typically, at least one tension member if pivotally attached at one end to a rigid arm and at the other end to the dock or to the single point mooring system.

In one embodiment, the at least one tension member is suspended from a lower part of the dock.

In an alternative embodiment, the at least one tension member is suspended from an upper part of the dock.

In one embodiment, the flexible hose is a catenary hose held above the surface of the water.

Alternatively, the catenary hose is held partly above and partly below the surface of the water.

Preferably, fluid transfer means are connected between the seabed and the single point mooring system.

Advantageously, the dock further comprises at least one thrust producing device mounted to the dock to facilitate movement of the dock relative to the single point mooring system or the stationary earth.

In addition, the dock further comprises variable buoyancy means to raise and lower the level of the dock in the water.

Typically, the variable buoyancy means comprises at least one tank, means to admit water to the tank to reduce buoyancy and means to supply gas to the tank to expel water therein in order to increase buoyancy.

The dock comprises a floor structure engageable against the hull of a vessel and a plurality of columns projecting upwardly from the floor structure, the columns arranged to allow a vessel to enter and exist the dock.

Advantageously, a winch mechanism is mounted on the single point mooring system, having a winch line attachable to a vessel and operable to facilitate entry of the vessel into the dock.

The apparatus further comprises loading means for loading or unloading contents to or from a vessel moored in the dock.

Typically, the at least one rigid arm and the at least one tension member are at least partially submerged.

Alternatively, the at least one rigid arm and the at least one tension member are located above the surface of the water.

In addition, the dock further comprises moveable means to rigidly engage the vessel once positioned in the dock.

The present invention also provides a method for mooring a vessel in an offshore environment utilizing the apparatus as claimed in claim 1, comprising the steps of aligning the dock with the direction of approach of a docking vessel, positioning the vessel within the dock, increasing the buoyancy of the dock to raise the level of the dock in the water until it engages against the underside of the hull of the vessel to suppress differential motion between the vessel and the dock, and loading or unloading material onto or from the vessel.

The present invention will now be described in detail, by way of example only, with reference to the accompanying drawings in which:

DETAILED DESCRIPTION OF THE PREFERRED EMBODIMENTS

When transferring fluid, and in particular cryogenic fluid such as LNG, between two floating structures in an offshore environment it is important that any relative motion between the floating structures is reduced to a minimum. Mooring the structures together in a conventional manner may decrease the relative motion but will not reduce it sufficiently. To achieve the desired reduction in the motion between the vessels it is required that a positive engagement is made between the two floating structures.

Figure 1:
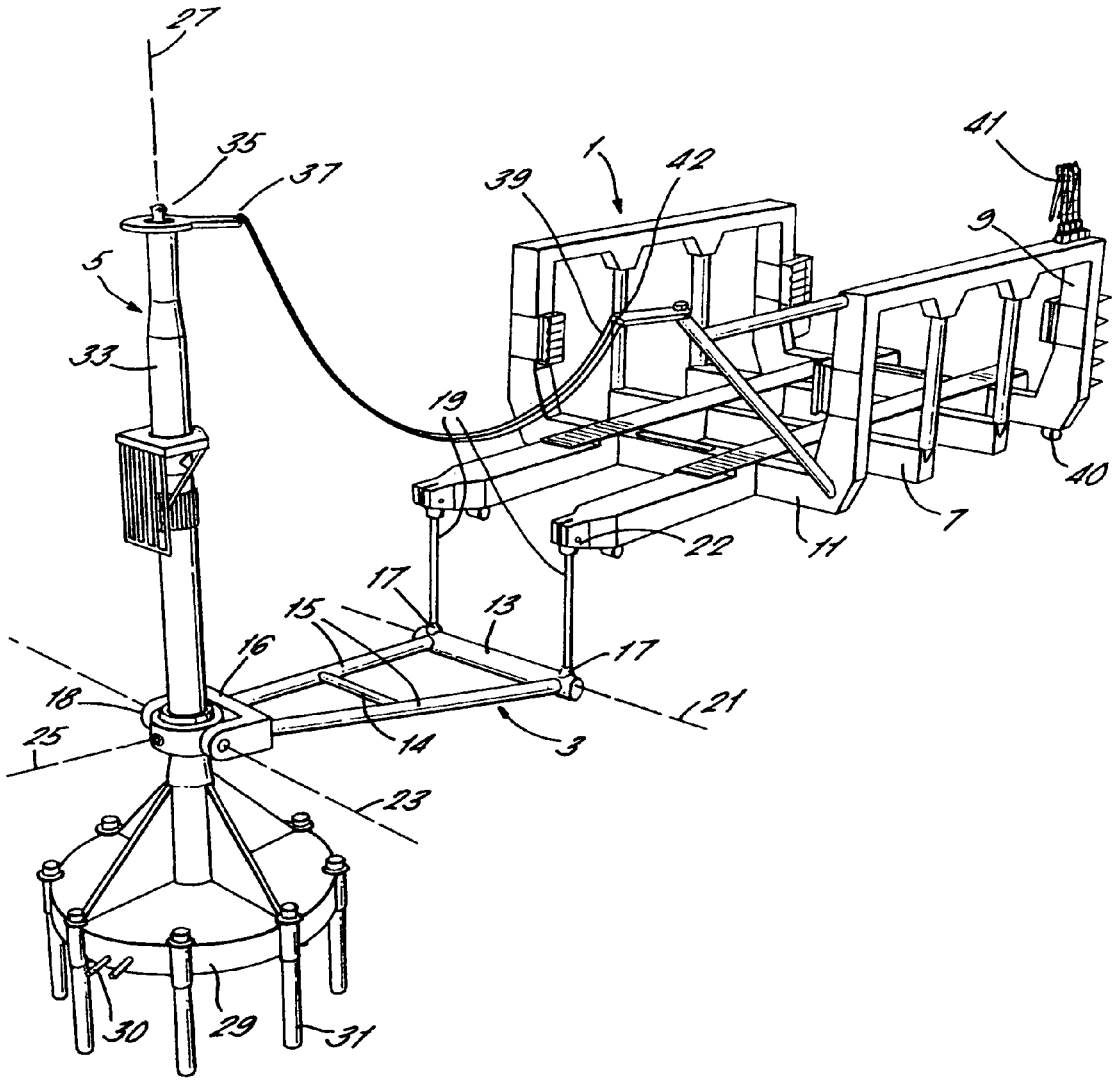
FIG. 1 is a perspective view of a first embodiment of the present invention illustrating a single point mooring system and a semi-submersible loading dock.

A schematic view of a first embodiment of the apparatus according to the present invention can be seen in FIG. 1. A semi-submersible loading dock, shown generally at 1, is attached by a mooring yoke 3 to a single point mooring system, shown generally at 5. The mooring yoke 3 acts to position the loading dock 1 at a sufficient distance from the single point mooring 5 such that a vessel 10 may be positioned within the loading dock 1 without colliding with the single point mooring system 5.

In cross-section the semi-submersible loading dock 1 is arranged in a U configuration having a generally horizontal loading dock floor 7 supporting generally vertical and perpendicular uprights 9. In order to accommodate relatively slender vessels, and yet provide a large enough floor area to prevent pitching of a vessel within the loading dock 1, it is preferred that the loading dock floor 7 is rectangular in shape, with each of the longer sides oriented in a direction that is generally parallel to the sides of a docking vessel 10. To provide entry and exit routes for a docking vessel 10 the uprights 9 are located along the long sides of the dock 1 such that the ends of the loading dock 1 are left open.

The loading dock floor 7 is typically constructed from steel box section girders permanently attached together in a single plane in a ladder type configuration. Within these box section girders are contained floatation chambers 11 which enable the buoyancy of the loading dock 1 to be increased or decreased and hence facilitate raising or lowering of the loading dock 1. Attached to the loading dock 1 are fluid transfer means 41, typically LNG loading/unloading equipment.

The mooring yoke 3 is a generally triangular space frame structure, having a base 13 and two long sides 15. One or more cross members 14 may be provided between the sides 15 to increase the stiffness of the structure. At the apex of the long sides 15 the mooring yoke 3 is provided with a first part 16 of a coupling for connection with a second part 18 attached to the single point mooring system 5. The coupling 16, 18 allows the mooring yoke 3 to rotate about generally horizontal axes 23 and 25 and about a generally vertical axis 27. At each end of the base 13 brackets 17 are provided for the connection of tension members 19 which connect the mooring yoke 3 to the loading dock 1. The bracket 17 facilitate articulation of the tension members around an axis 21 that is generally parallel to the base 13. The tension members 19 may be attached to the loading dock floor 7 at any suitable point for example at mounting points 22 at one end of the dock floor 7. The weight of the mooring yoke 3 and, if required, additional ballast contained within the mooring yoke 3 and/or the lower part of the tension members 19, retains tension in the tension members 19 at all times.

It is envisaged that, in addition to the embodiments of the present invention already described, the apparatus of the present invention may be modified so that the mooring yoke 3 and the tension members 19 are held above the surface of the water.

The single point mooring system 5 comprises a base 29 rigidly attached to the sea bed and an upright 33 which extends upwards from the base 29 to a level above the surface of the water. Attached to the base 29 are fluid connectors 30 for connection to one or more subsea pipelines (not shown). Located on the upright 33 is the second part 18 of a coupling for connection of the mooring yoke 3. The coupling 16, 18 enables the mooring yoke 3 and loading dock 1 to weathervane around the upright 33. At the top of the upright 33 there is a fluid swivel 35 which is connected to the ends 37 of flexible hoses 39.

The other ends 42 of the flexible hoses 39 are attached to the loading dock 1 for fluid transfer. In order that the flexible hoses 39 do no restrict movement of the loading dock 1 relative to the single point mooring system the flexible hoses 39 take a catenary form. the length of the flexible hoses 39 may be chosen so that the flexible hoses 39 are held above the water or partially in contact with the water.

Figure 2:
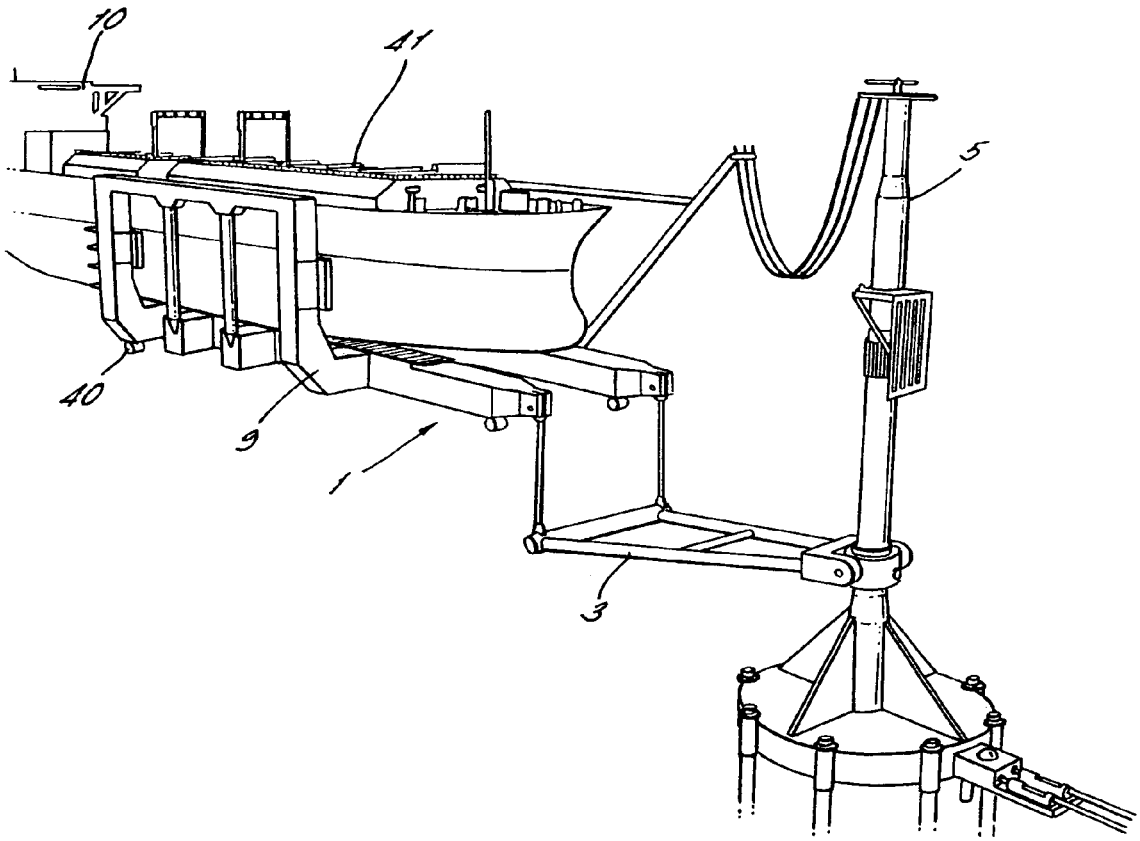
FIG. 2 is a further view of the first embodiment shown in FIG. 1 illustrating a tanker positioned within the loading dock.

In FIG. 2 a vessel 10 can be seen docked within the loading dock 1 of FIG. 1. to aid with the docking of a vessel 10 the loading dock 1 is equipped with a plurality of thrusters 40 which are typically attached to the long sides of the loading dock 1. These thrusters 40 are used in the preliminary stages to align the longitudinal axis of the loading dock 1 with the line of approach of the vessel 10 and also during the final stages of docking, to position the loading dock 1 such that contact between the sides of the vessel 10 and the uprights 9 is limited. A winch (not shown) and winch line (not shown) may be provided for attachment to an approaching vessel 10 to further control progress of the vessel 10 into the loading dock 1.

The method of operation of the first embodiment of the present invention will now be described in reference to FIGS. 1 and 2.

The apparatus of the present invention achieves positive engagement of the floating structures by using the adjustable buoyancy floatation chambers 11 which are able to force the loading dock floor 7 into contact with the bottom of the hull of the vessel 10 with sufficient upthrust that the loading dock 1 and vessel 10 move in unison.

When the loading dock 1 is empty and the buoyancy of the floatation chambers 11 is decreased, by venting the floatation chambers 11 to allow egress of air and ingress of water, in order to position it in a semi-submerged state. This serves to purposes, firstly, it prepares the loading dock 1 to receive a new vessel 10 and secondly it lowers the centre of gravity of the loading dock 1 with respect to the surface of the water and consequently increases it stability.

On the approach of a vessel 10 the loading dock 1 must be maneuvered into a position in which its longitudinal axis is substantially aligned with the longitudinal axis of the vessel 10. Movement of the loading dock 1 is induced by the thrusters 40 located along the sides of the loading dock 1. Control of these thrusters 40 is effected by crew members located upon the loading dock 1. Approach of the vessel 10 to the loading dock 1 is made by the vessel 10 under its own power, however, once the vessel 10 is close to the loading dock 1 a winch line may be attached to the bow of the vessel 10 so that the ship can be guided into the loading dock 1 under greater control Once the vessel 10 has proceeded through the loading dock 1 to such an extent that the loading dock 1 is positioned approximately midships and the loading/unloading points on the ships are adjacent to the fluid transfer means 41, further progress of the vessel 10 is halted. At this point securing means (not shown) may be attached between the vessel 10 and the loading dock 1 to maintain the position of the vessel 10 within the loading dock 1. The securing means may comprise one or more flexible securing lines and/or one or more rigid structures attached between the loading dock 1 and the vessel 10.

Once any such securing means have been secured the buoyancy of the floatation chambers 11 is increased, by venting the floatation chambers 11 to permit expulsion of water under the pressure of air supplied to the floatation chambers 11 from a compressed air supply. The loading dock 1 then rises in the water until the hull of the vessel 10 contacts the loading dock floor 7. A measured further increase in the buoyancy of the floatation chambers 11 then acts to ensure contact between the vessel 10 and the loading dock 1 for all sea conditions, thus suppressing differential motion between the dock 1 and the vessel 10. The vertical movement of the loading dock 1 is enabled by pivoting of the mooring yoke 3 around the horizontal axis 23. Once the vessel 10 has been docked loading/unloading can be carried out by any conventional and appropriate means.

Once the transfer of fluid is complete and the fluid transfer means 41 has been detached from the vessel 10 the buoyancy of the floatation chambers 11 is decreased and the loading dock floor 7 can be lowered away from the vessel 10 to its default empty position. Any securing means may now be removed and with the assistance of a winch the vessel 10 exits from the loading dock 1. Due to the positioning of the single point mooring system the vessel 10 exits from the loading dock 1 in the opposition direction to the direction in which it entered the loading dock 1. use of the thrusters 40 may additionally be required to ensure that contact is not made between the hull and the loading dock 1.

Figure 3:
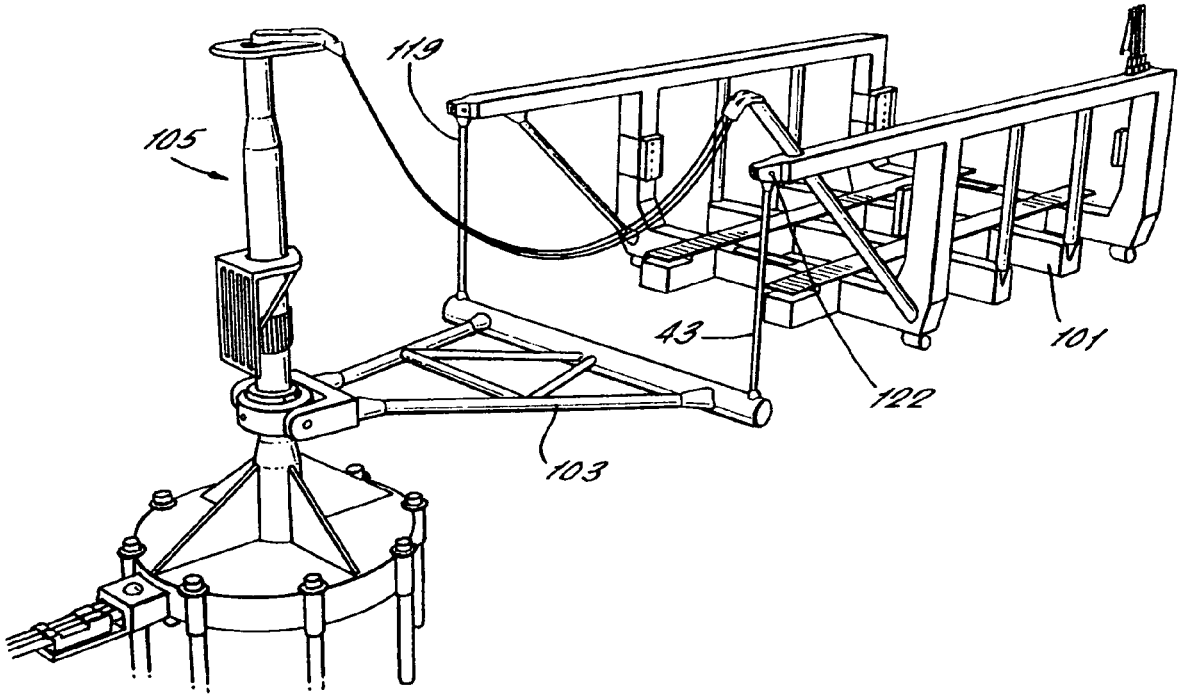
FIG. 3 is a perspective view of a second embodiment of the present invention illustrating a single point mooring system and a semi-submersible loading dock.
Figure 4:
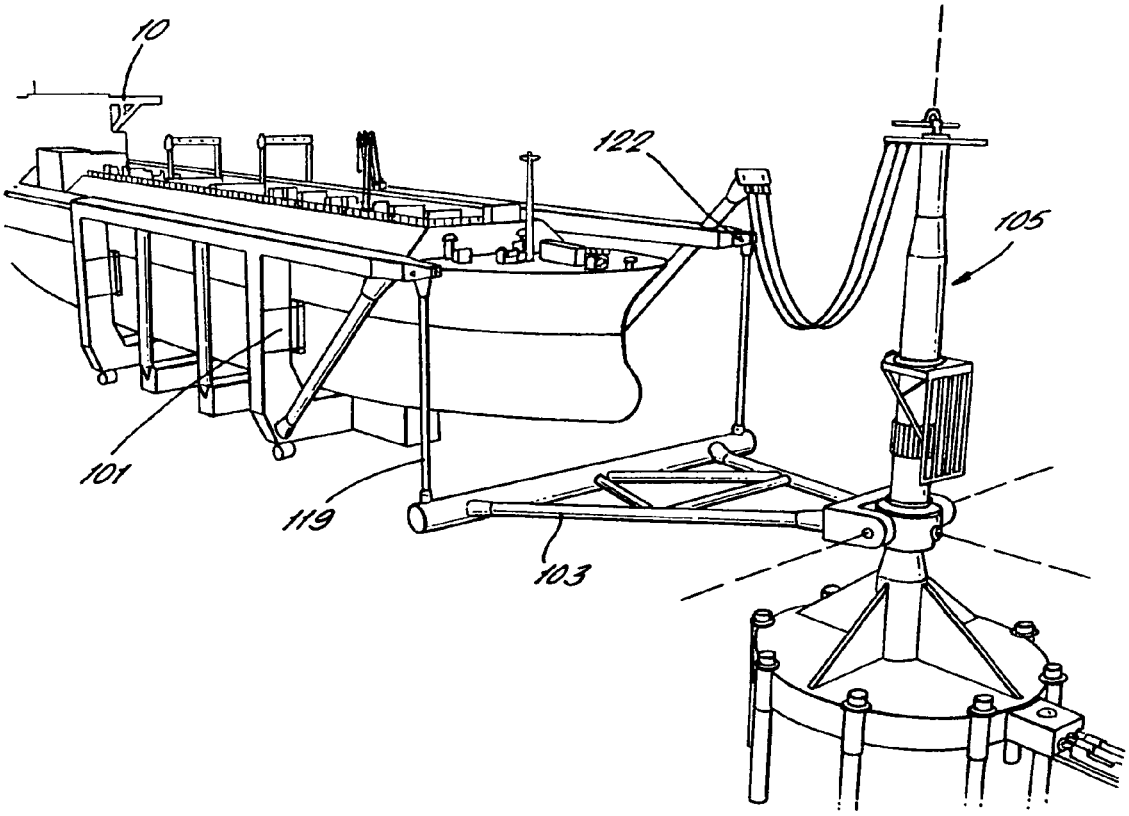
FIG. 4 is a further view of the second embodiment shown in FIG. 3 illustrating a tanker positioned within the loading dock.

A second embodiment of the present invention is shown in FIGS. 3 and 4. This is generally similar to the first embodiment, but it is envisaged for mooring of a vessel in shallower water. The apparatus comprises a semi-submersible loading dock 101, a mooring yoke 103 and a single point mooring system 105. To enable the mooring yoke 103 to be positioned lower than the bottom of the hull the tension members 119 are attached to the top of the loading dock 101 at the mounting points 122. The spacing of the tension members 119 requires that the width of the mooring yoke 103 is greater than in the first embodiment.

Figure 5:
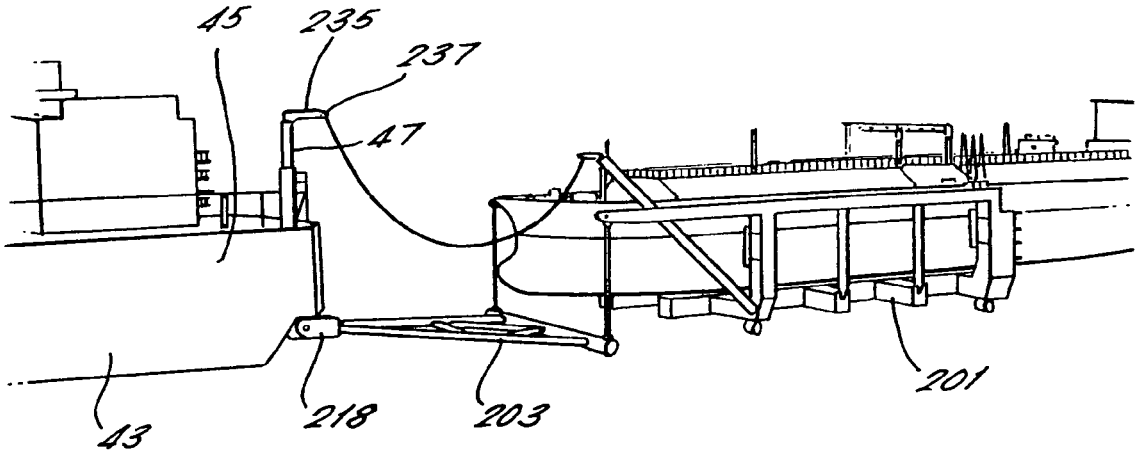
FIG. 5 is a perspective view of a third embodiment of the present invention illustrating a semi-submersible loading dock attached to a floating vessel.

A third embodiment of the invention is shown in FIG. 5. In this embodiment the single point mooring system to which the mooring yoke 203 is attached consists of a floating vessel 43, which itself may be moored to the seabed by means of a single point mooring. The mooring yoke 203 is attached between the vessel 43 and the loading dock 201. Provided on the hull of the vessel 43 and beneath the surface of the water is a first part 218 of a coupling to which the apex of the mooring yoke 203 is attached. Attached to the deck 45 of the vessel 43 is an upright 47 which comprises a fluid swivel 235 for connection to flexible hoses 237 as described in the previous embodiments.

Figure 6:
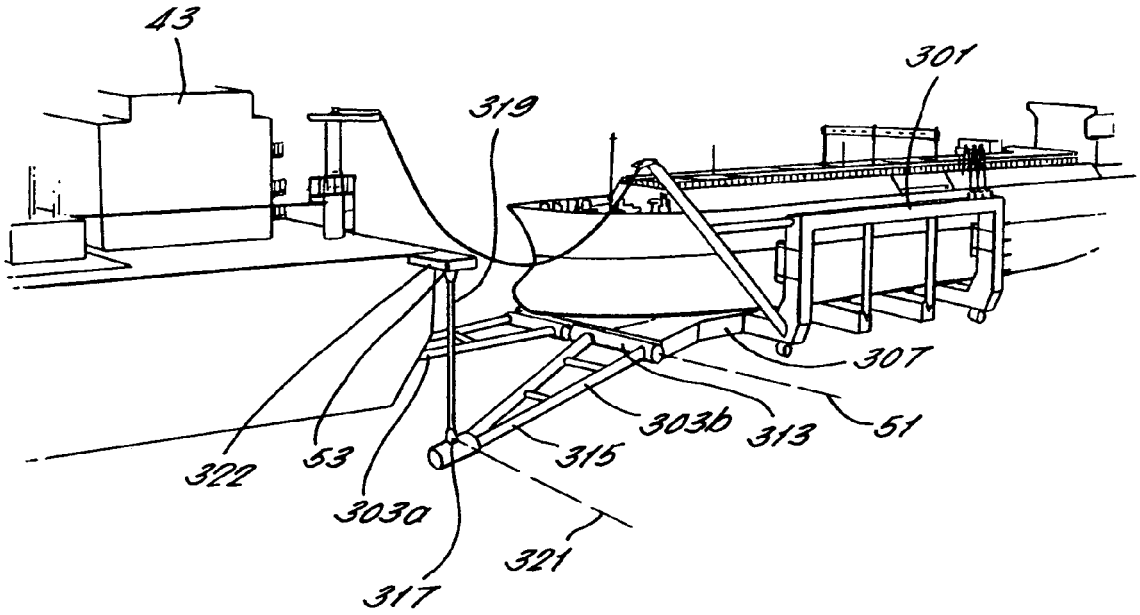
FIG. 6 is a perspective view of a fourth embodiment of the present invention illustrating a semi-submersible loading dock attached to a floating vessel.

A fourth embodiment of the invention is shown in FIG. 6. This embodiment also comprises a floating vessel 43 attached to a single point mooring system (not shown) but utilizes two identical but handed mooring yokes 303*a*, 303*b* that are fixed to the loading dock 301 such that they may only rotate about a single generally horizontal axis 51. Each mooring yoke 303*a*, 303*b* is generally triangular and has a base 303 and two long sides 315 of unequal length. At the apex of the long sides 315 is provided a bracket 317 for attachment of a tension member 319. The base 313 acts as a hinge for connection to the floor 307 of the loading dock 301. Tension members 319 connect the mooring yokes 303*a*, 303*b* to the vessel 43 and the vessel 43 is provided with an outrigger 53 on either side of the hull for attachment of these tension member 319. The tension members 319 are attached with brackets 322 that permit them to articulate about axis 321.

The method of operation of the further embodiments of the present invention is substantially similar to the method of operation described previously in reference to FIGS. 1 and 2.

The reader will realize that various modifications and variations to the specific embodiment described are also possible without departing from the scope of the claims.

While the specification describes particular embodiments of the present invention, those of ordinary skill can devise variations of the present invention without departing from the inventive concept.

I claim:

1. Apparatus for mooring a floating vessel comprising a semi-submersible floating dock, a single point mooring system and at least one rigid arm, wherein the rigid arm is pivotally attached to one of the semi-submersible floating dock and the single point mooring system and is suspended from the other of the semi-submersible floating dock and the single point mooring system by at least one tension member.

2. Apparatus as claimed in claim 1, wherein the single point mooring system comprises a seabed mounted structure and the at least one rigid arm is attached to the structure for rotation about a substantially vertical axis relative to the structure and for rotation about a substantial horizontal axis in use.

3. Apparatus as claimed in claim 1, wherein the single point mooring system comprises a floating vessel and the at least one rigid arm is attached to the vessel for rotation about a substantially horizontal axis in use.

4. Apparatus as claimed in claim 1, wherein the single point mooring system comprises a floating vessel and further comprising two rigid arms, each pivotally mounted to the dock for rotation about a substantially horizontal axis in use and suspended from the floating vessel by at least one tension member.

5. Apparatus as claimed in claim 1, wherein the at least one rigid arm is a substantially triangular frame.

6. Apparatus as claimed in claim 1, wherein at least one flexible hose is connected between a swivel on the single point mooring system and the dock for fluid transfer therebetween.

7. Apparatus as claimed in claim 1, wherein the at least one tension member is pivotally attached at one end to the at least one rigid arm and at the other end to the dock or to the single point mooring system.

8. Apparatus as claimed in claim 1, wherein the at least one tension member is suspended from a lower part of the dock.

9. Apparatus as claimed in claim 1, wherein the at least one tension member is suspended from an upper part of the dock.

10. Apparatus as claimed in claim 1, wherein fluid transfer means are connected between the seabed and the single point mooring system.

11. Apparatus as claimed in claim 1, wherein the dock further comprises at least one thrust producing device mounted to the dock to facilitate movement of the dock relative to the single point mooring system or the stationary earth.

12. Apparatus as claimed in claim 1, wherein the dock further comprises variable buoyancy means to raise and lower the level of the dock in the water.

13. Apparatus as claimed in claim 1, wherein the dock comprises a floor structure engageable against the hull of a vessel and a plurality of columns projecting upwardly from the floor structure, the columns arranged to allow a vessel to enter and exit the dock.

14. Apparatus as claimed in claim 1, wherein a winch mechanism is mounted on the single point mooring system, having a winch line attachable to a vessel and operable to facilitate entry of the vessel into the dock.

15. Apparatus as claimed in claim 1, wherein the dock further comprises loading means for loading or unloading contents to or from a vessel moored in the dock.

16. Apparatus as claimed in claim 1, wherein the at least one rigid arm and the at least one tension member are at least partially submerged.

17. Apparatus as claimed in claim 1, wherein the at least one rigid arm and the at least one tension member are located above the surface of the water.

18. Apparatus as claimed in claim 1, wherein the dock further comprises moveable means to rigidly engage the vessel once positioned in the dock.

19. Apparatus as claimed in claim 3, wherein the floating vessel is itself moored by a single point mooring system.

20. Apparatus as claimed in claim 5, wherein the at least one rigid arm is attached to the single point mooring system at an apex of the substantially triangular frame.

21. Apparatus as claimed in claim 5, wherein the hose is a catenary hose held above the surface of the water.

22. Apparatus as claimed in claim 6, wherein the catenary hose is held partly above and partly below the surface of the water.

23. Apparatus as claimed in claim 12, wherein the variable buoyancy means comprises at least one tank, means to admit water to the tank to reduce buoyancy and means to supply gas to the tank to expel water therein in order to increase buoyancy.

24. A method for mooring a vessel in an offshore environment, utilizing the apparatus as claimed in claim 1, comprising the steps of aligning the dock with the direction of approach of a docking vessel, positioning the vessel within the dock, increasing the buoyancy of the dock to raise the level of the dock in the water until it engages against the underside of the hull of the vessel to suppress differential motion between the vessel and the dock, and loading or unloading material onto or from the vessel.

* * * * *